US006997159B2

(12) United States Patent
Stockner et al.

(10) Patent No.: US 6,997,159 B2
(45) Date of Patent: Feb. 14, 2006

(54) ELECTRICALLY CONTROLLED FLUID SYSTEM WITH ABILITY TO OPERATE AT LOW ENERGY CONDITIONS

(75) Inventors: Alan R. Stockner, Metamora, IL (US); Rene Schulz, Herdorf (DE); Olaf Ohligschlaeger, Herdorf (DE); Ronald D. Shinogle, Peoria, IL (US); Bernhard Kirsch, Herdorf (DE); Clifford E. Cotton, III, Pontiac, IL (US)

(73) Assignee: Caterpillar Inc., Peoria, IL (US)

( * ) Notice: Subject to any disclaimer, the term of this patent is extended or adjusted under 35 U.S.C. 154(b) by 336 days.

(21) Appl. No.: 10/372,692

(22) Filed: Feb. 21, 2003

(65) Prior Publication Data

US 2004/0163621 A1 Aug. 26, 2004

(51) Int. Cl.
*F02D 13/04* (2006.01)
*F02M 51/00* (2006.01)
*F01L 9/00* (2006.01)

(52) U.S. Cl. ..... 123/322; 123/490; 123/90.11; 251/129.01; 239/585.1

(58) Field of Classification Search ..... 123/472, 123/490, 90.11, 90.12, 322, 333, 296; 251/129.01; 239/585.1
See application file for complete search history.

(56) References Cited

U.S. PATENT DOCUMENTS 5,738,075 A 4/1998 Chen et al.
6,119,960 A * 9/2000 Graves ..... 239/92
6,129,072 A * 10/2000 Graves ..... 123/446
6,253,736 B1 * 7/2001 Crofts et al. ..... 123/498
6,526,943 B1 * 3/2003 Augustin ..... 123/446
6,549,390 B1 * 4/2003 Ozawa et al. ..... 361/139
6,598,591 B1 * 7/2003 Lewis ..... 123/467
6,622,694 B1 * 9/2003 Mickiewicz et al. ..... 123/322
6,807,950 B1 * 10/2004 Boss et al. ..... 123/506
6,837,221 B1 * 1/2005 Crofts et al. ..... 123/467
6,845,754 B1 * 1/2005 Pecheny et al. ..... 123/446
6,854,442 B1 * 2/2005 Satapathy et al. ..... 123/321
6,863,055 B1 * 3/2005 Rueger ..... 123/478
2003/0037765 A1 * 2/2003 Shafer et al. ..... 123/321
2003/0106532 A1 * 6/2003 Tian et al. ..... 123/446
2005/0034708 A1 * 2/2005 Augustin ..... 123/446
2005/0126534 A1 * 6/2005 Kikutani ..... 123/299

* cited by examiner

*Primary Examiner*—Hai Huynh
(74) *Attorney, Agent, or Firm*—Liell & McNeil

(57) ABSTRACT

Electrically controlled fuel injection systems should be able to operate at low voltage. In order to operate an electrically controlled fuel injection system at low voltage, the voltage available to an electrical actuator is monitored. The electrical actuator is coupled to a valve positioned within a passageway in which high pressure actuation fluid flows to and from an hydraulically actuated device, such as a fuel injector and/or an engine brake. If the voltage available to the electrical actuator falls below a predetermined voltage, the pressure differential across the valve is reduced. Although the principal application of the present invention is in the fuel injection system, the present invention has application in any electrically controlled fluid system at low voltage.

20 Claims, 6 Drawing Sheets

ELECTRICALLY CONTROLLED FLUID SYSTEM WITH ABILITY TO OPERATE AT LOW ENERGY CONDITIONS

TECHNICAL FIELD

The present invention relates generally to electrically controlled fluid systems, and more particularly to a method for operating electrically controlled valves within the system during periods of low energy availability.

BACKGROUND

In several diesel engines today, hydraulically-actuated devices, such as hydraulically-actuated fuel injectors and engine brakes, are controlled by electrically-actuated fluid control valves. Depending on the positioning of a valve member, the fluid control valve either connects the hydraulic device to a source of high pressure actuation fluid causing the device to activate, or connects the hydraulic device to a low pressure actuation reservoir causing the device to deactivate, reset itself, or remain inactive. The movement of the valve member is controlled by an electrical actuator, such as a solenoid or piezo actuator. For instance, hydraulically actuated fuel injectors such as that shown in U.S. Pat. No. 5,738,075 issued to Chen et al. on Apr. 14, 1998, include a solenoid driven fluid control valve that is attached to an injector body.

Typically, in order to connect the hydraulic device to the source of high pressure, electric current is supplied to the electrical actuator to move the valve member against the bias of a spring. However, over the years, engineers have found that a pressure differential across the fluid control valve can affect the ability of the valve to operate in a predictable manner. The pressure differential across the fluid control valve can cause the velocity of the fluid to increase and the pressure to decrease, especially in the region around a valve seat. These changes within the pressure and velocity of the fluid can create flow forces that act against the movement of the valve member. Thus, the electrical actuator must move the valve member not only against the bias of the spring but also against the flow forces. These flow forces generally increase as the pressure differential across the valve increases. Engineers design the hydraulic system such that the voltage available to the electrical actuator is sufficient to move the valve member from its closed position toward its open position against the bias of the spring and the flow forces at the highest expected pressure differentials, which corresponds to the highest expected rail pressure in the case of a fuel injection system.

While the method of using electrically-actuated fluid control valves in order to control hydraulically-actuated devices has performed well, there is room for improvement. For instance, federal regulations require that most vehicles and machinery be able to operate within a range of voltage, such as 9–16 volts. Thus, engineers are constantly searching for strategies to operate electronically controlled engine components, such as fuel injectors or engine brakes, at the lower end of this voltage range. Further, when voltage (energy) available to the electrical actuator decreases, possibly due to a problem within the electrical circuitry or power supply of the vehicle or machinery, the electronic control module may be unable to provide sufficient electric current to the electrical actuator in order to move the valve member to, and hold the valve member in, its open position at the higher rail pressures. Thus, when the voltage falls below a certain level, the fluid control valve is unable to sufficiently fluidly connect the fuel injector to the source of high pressure actuation fluid and activate the fuel injector in a predictable manner. In other words, the valve may behave erratically, or not at all. The result being that fuel cannot adequately and/or accurately be injected into the engine and the vehicle or machinery will then stall and/or misfire. This can lead to towing expenses and other lost productivity and inconveniences. Moreover, if the electrical problem causing the voltage to decrease occurred at a time when the engine brake is needed in order to slow the vehicle or machinery, such as when descending a steep hill, the engine brake may not operate properly, potentially resulting in a run-away vehicle.

The present invention is directed at overcoming one or more of the problems set forth above.

SUMMARY OF THE INVENTION

In one aspect of the present invention, a method of operating an electrically controlled fluid system includes a step of positioning a valve within a fluid passage. The valve is coupled to an electrical actuator, and electrical energy available to the electrical actuator is monitored. If the electrical energy available to the electrical actuator is less than a predetermined electrical energy, a pressure differential across the valve is limited.

In another aspect of the present invention, an electrically controlled fluid system includes a fluid passage that is separated by a valve into a first portion that is fluidly connected to a source of high pressure and a second portion. The valve is coupled to an electrical actuator. A pressure controlling device is operably coupled to the source of pressurized fluid. An electronic control module includes a low electrical-energy pressure limiting algorithm and is in control communication with the electrical actuator and the pressure controlling device.

In still another aspect of the present invention, an article includes a computer readable data storage medium, upon which an electrical energy availability monitoring algorithm and a low energy determining algorithm are recorded. A pressure limiting algorithm is also recorded on the medium and is operable when the low energy determining algorithm determines that an available electrical energy is less than a predetermined electrical energy.

DETAILED DESCRIPTION

Figure 1:
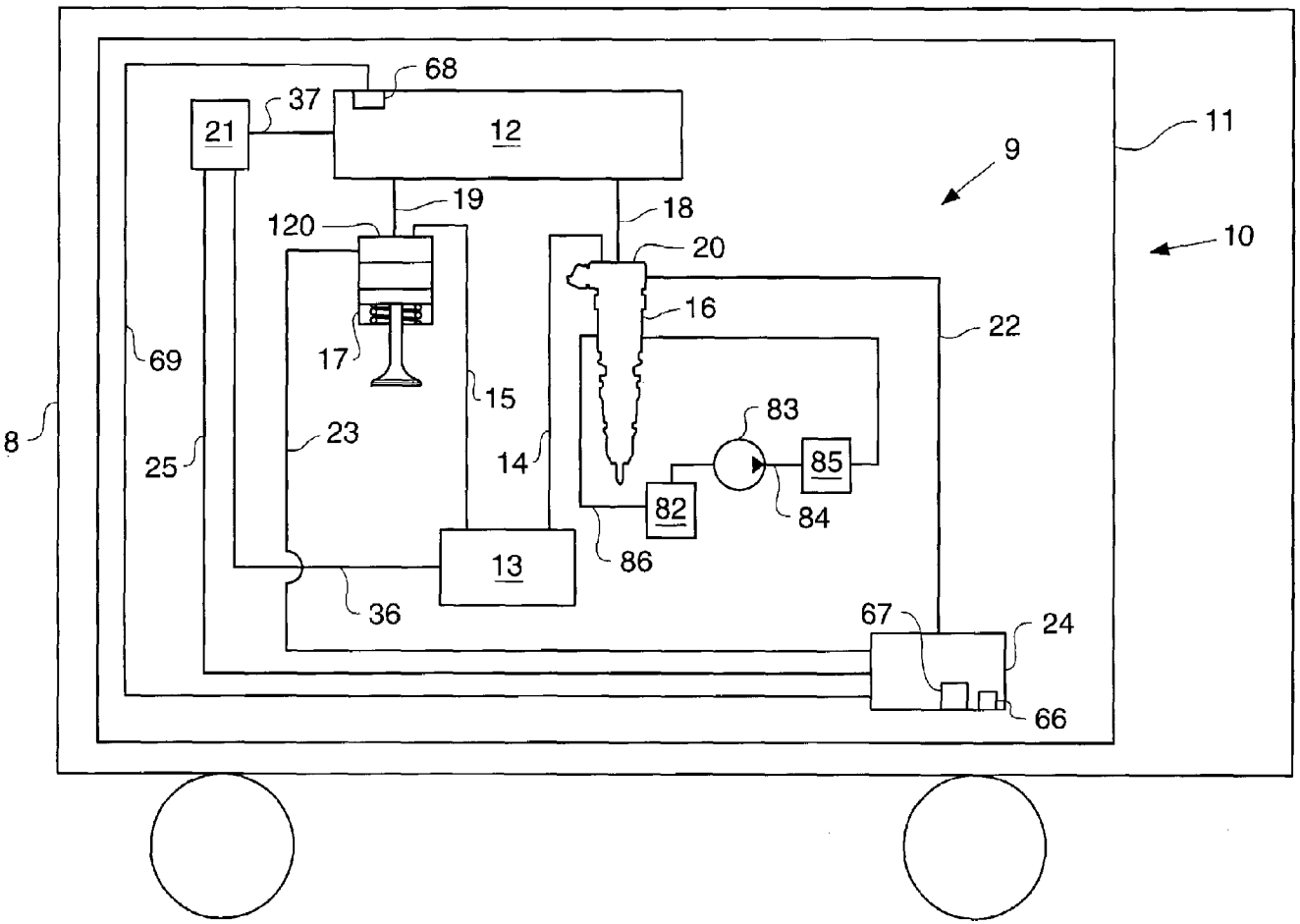
FIG. 1 is a schematic representation of an electrically controlled fluid system according to the present invention.

Referring to FIG. 1, there is shown an electrically-controlled fluid system according to the present invention. In the example embodiment, the fluid system is a hydraulic system 9 within an engine 10 attached to a vehicle 8. However, it should be appreciated that the present invention could be utilized in any electronically-controlled fluid system, regardless of whether the fluid system is a hydraulic system or part of an engine. The engine 10 includes an engine housing 11 to which a low pressure actuation fluid reservoir 13 is attached. While low pressure actuation fluid reservoir 13 is preferably an oil pan that has engine lubricating oil, it should be appreciated that other fluid sources having an amount of available fluid, such as coolant, transmission fluid or fuel, could instead be used. A pump 21 pumps actuation fluid from the low pressure reservoir 13 via a low pressure supply line 36 and delivers the same via a high pressure supply line 37 to a source of pressurized fluid. In this instance, the source of pressurized fluid is a common rail 12. A pressure sensor 68 is preferably positioned within the common rail 12 and is in communication with an electronic control module 24 via a sensor communication line 69. Although the pressure sensor 68 is illustrated as positioned within the common rail 12, it should be appreciated that the pressure sensor 68 could be positioned at any suitable point within the hydraulic system 9 that contains the pressurized fluid, such as within the high pressure supply line 37. The pressure sensor 68 periodically samples the actual pressure of the actuation fluid being supplied to the fuel injector 16 and the engine brake 17. Although only one fuel injector 16 is shown, the engine 10 is preferably a multi-cylinder engine with a plurality of fuel injectors that share the same common rail. Preferably, the frequency of sampling and processing is selected in order to determine a mean or average pressure that is not too sensitive to transient effects. Actuation fluid not delivered to the common rail 12 will be moved back toward the low pressure reservoir 13 via the low pressure supply line 36 for re-circulation through the hydraulic system 9.

The pump 21 is preferably an electronically controlled variable delivery pump, such as a sleeve metered fixed displacement variable delivery pump of a type manufactured by Caterpillar, Inc. of Peoria Ill. Therefore, a portion of the pump 21 is a pressure limiting device. The output of the variable delivery pump 21 is controlled by the electronic control module 24 via a pump communication line 25. Those skilled in the art will appreciate that other pump/controller strategies could be substituted. For instance, a fixed displacement pump and a rail pressure control valve that allows fluid to leak from a common rail 12 to the low pressure reservoir 13 when needed could be utilized in the present invention.

Figure 3:
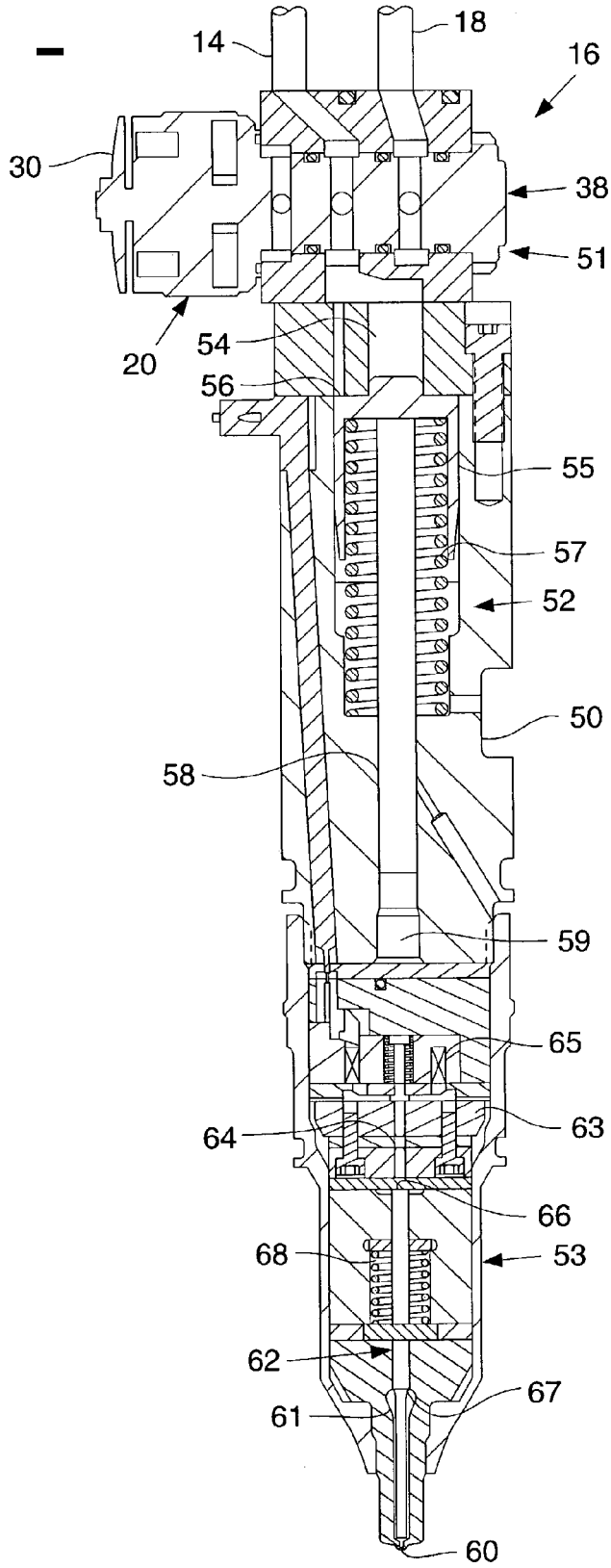
FIG. 3 is a sectioned side diagrammatic view of a fuel injector according to one aspect of the present invention.
Figure 4:
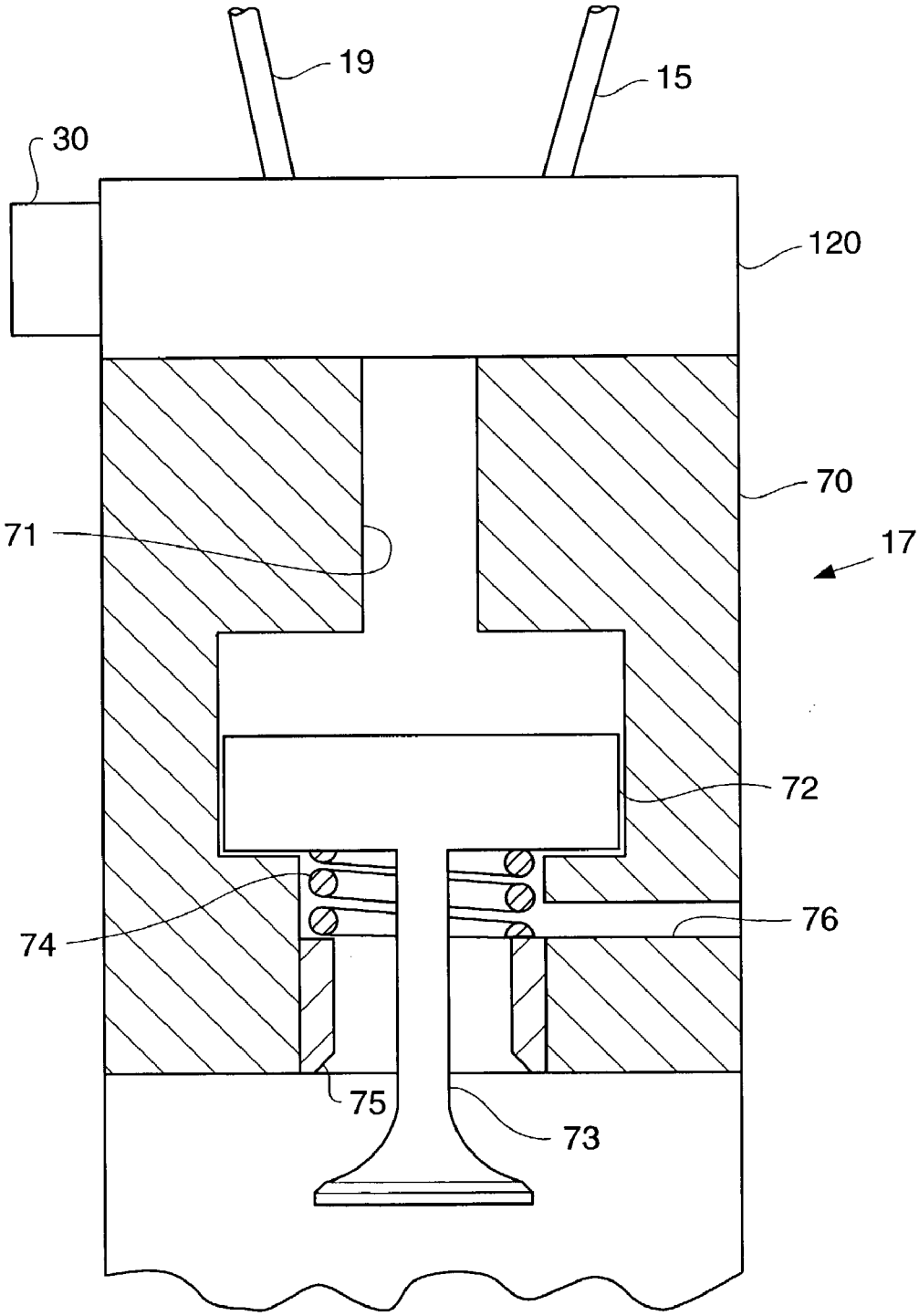
FIG. 4 is a sectioned side diagrammatic representation of an engine brake according to another aspect the present invention.

Fluid control valve assemblies 20, 120 are positioned within fluid passageways and control the flow of actuation fluid to and from the fuel injector 16 and engine brake 17, respectively. The fluid control valve assemblies 20, 120 separate the fluid passageways into a first portion, a second portion, and preferably a third portion. The high pressure actuation fluid flowing out of the common rail 12 is delivered to the engine brake 17 and the fuel injector 16 via the first portions of the fluid passageways, in this instance being an engine brake supply line 19 and the fuel injector supply line 18, respectively. The high pressure actuation fluid activates the fuel injector 16 and the engine brake 17 within the second portions of the fluid passageways, in this instance being the piston bore 54 included within the fuel injector 16 (as shown in FIG. 3) and the engine brake fluid passage 71 included within the engine brake 17 (as shown in FIG. 4). Once the high pressure actuation fluid has performed its work in either the engine brake 17 and the fuel injector 16, the actuation fluid is returned to the low pressure actuation fluid reservoir 13 via the third portions of the fluid passageways, in this instance being an engine brake drain line 15 and a fuel injector drain line 14, respectively. Both the fuel injector 16 and the engine brake 17 preferably include the fluid control valve assembly 20 and 120, respectively. Both fluid control valve assemblies 20, 120 perform similarly within the fuel injector 16 and the engine brake 17. The fuel injector fluid control valve assembly 20 is in electrical communication with the electronic control module 24 via a fuel injector communication line 22. The engine brake fluid control valve assembly 120 is in electrical communication with the electronic control module 24 via an engine brake communication line 23. Although the fluid control valve assemblies 20, 120 are illustrated in FIG. 1 as attached to the fuel injector 16 and the engine brake 17, those skilled in the art should appreciate that the fluid control valve assemblies 20, 120 could be separate from the fuel injector 16 and the engine brake 17 and positioned at a point within the hydraulic system 9, such as along the supply lines 19, 18. Further, rather than utilizing a fluid control valve assembly 20, 120 for each the fuel injector 16 and the engine brake 17, one valve assembly could control the flow of actuation fluid to and from both the engine brake 17 and the fuel injector 16. Also, those skilled in the art should appreciate that the fluid control valve assembly 20, 120 can be utilized to control the flow of actuation fluid to and from any hydraulic device.

Fuel is drawn from a fuel tank 82 by a fuel transfer pump 83 and circulated to the fuel injector 16 via a fuel supply line 84 after passing through a fuel filter 37. Fuel transfer pump 36 is preferably a constant flow electric pump with a capacity sized to meet the maximum demands for engine 10. Also, fuel transfer pump 83 and fuel filter 85 may be contained in a common housing. Any fuel not used by the fuel injectors 16 is recirculated to fuel tank 82 via fuel return line 86. Fuel in the fuel supply and return lines 84 and 86 are at a relatively low pressure relative to that in common rail 12, which contains pressurized oil. In other words, the example fuel injection system includes no high pressure fuel lines, and the fuel is pressurized to injection levels within the fuel injector 16, and then usually for only a brief period of time during an injection sequence.

A low electrical energy-pressure limiting algorithm is programmed into an article that includes a computer readable data storage medium 67. The article 67 is preferably included in memory available to the electronic control module 24. The low electrical energy-pressure limiting algorithm enables the electronic control module 24 to control the electrically controlled hydraulic system 9 such that the vehicle or machinery will continue to operate even in low voltage situations. The low electrical energy-pressure limiting algorithm includes an electrical energy availability monitoring algorithm, preferably an engine hydraulic system voltage availability monitoring algorithm. This enables the electronic control module 24 to monitor the voltage available to operate the fluid control valve assemblies 20, 120 within the hydraulic system 9. The electronic control module 24 is in communication with a voltage sensor 66. The voltage sensor 21 could be positioned at any point within the circuitry controlling the hydraulic system 9 or elsewhere in the vehicle's electrical system.

A low energy determining algorithm is also programmed into the memory of the electronic control module 24. The low energy determining algorithm preferably includes a voltage comparison algorithm that enables the electronic control module 24 to compare the available voltage to a predetermined voltage. The predetermined voltage is preferably the voltage required to maintain operation of the fluid control valve assemblies 20, 120 at the highest rail pressures. The electronic control module 24 also includes a pressure limiting algorithm that is operable if the voltage comparison algorithm determines that the available voltage is less than the predetermined voltage. Once the pressure limiting algorithm is initiated, a common rail pressure determining algorithm will determine a limited maximum rail pressure at which the hydraulic system 9 will operate. The engine hydraulic system rail pressure controlling algorithm will command the variable delivery pump 21 via the pump communication line 25 to control the rail pressure so as not to exceed the limited maximum rail pressure.

Figure 2:
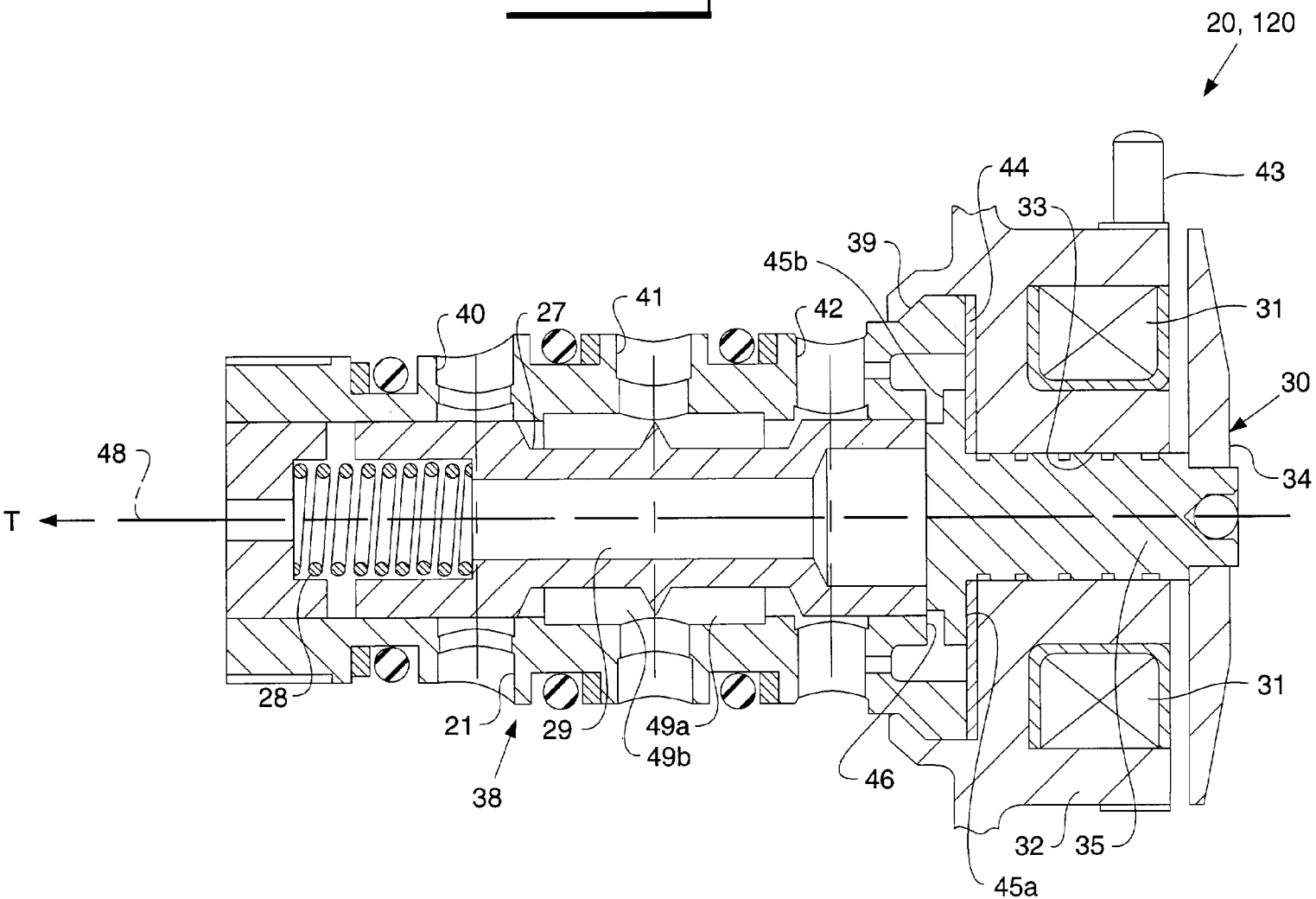
FIG. 2 is a sectioned side diagrammatic representation of a fluid control valve assembly according to one aspect of the present invention.

Referring to FIG. 2, there is shown a diagrammatic representation of a fluid control valve assembly 20, 120 according to the present invention. The valve assembly 20, 120 includes a fluid control valve 38 coupled to a first solenoid actuator 30. Although the present invention is illustrated as using a solenoid actuator 30, it should be appreciated that the present invention contemplates the use of any suitable electrical actuator, such as piezos, voice coils, etc. The fluid control valve 38 includes a valve body 39 which is preferably attached to a stator 32 of the first solenoid actuator 30. The solenoid actuator 30 includes at least one solenoid coil 31 that is mounted in the stator 32. The stator 32 defines a guide bore 33 in which a push pin 35 is preferably located. The push pin 35 is movable between a first position, as shown, and a second position within the guide bore 33. The push pin 35 preferably moves along a centerline 48 of the valve assembly 20, 120. An armature 34 is positioned adjacent to the solenoid coil 31 and attached to the push pin 35. The attachment is completed by inserting a ball into one end of the push pin 35, causing deformation that secures the armature 34 to the push pin 35. An electrical connector 43 attached to the solenoid actuator 30 is the means by which the electrical energy is supplied to the solenoid actuator 30. The solenoid actuator 30 is in communication with the electronic control module 24 via the fuel injector communication line 22 and the engine brake communication line 23 (FIG. 1).

The fluid control valve 38 includes a moveable spool valve member 27 which is biased into contact with the push pin 35 by a biasing spring 28. Nevertheless, those skilled in the art will appreciate that the invention also contemplates pull type configurations, such as one in which the value member is attached to the armature. Although the valve member 27 is illustrated as a spool valve member, it should be appreciated that the valve member 27 could be of a different shape or type, such as a poppet valve member. Further it should be appreciated that the valve body 39 and the spool valve member 27 could define any number of passages, even though the present invention is described for a three way valve. The spool valve member 27 defines an internal passage 29, a first annulus 49*a*, and a second annulus 49*b*. The valve body 39 defines a supply passage 40, an actuation passage 41, and a drain passage 42. The supply passage 40 is fluidly connected with a source of high pressure actuation fluid, preferably the common rail 12, via the supply lines 19, 18. The drain passage 42 is in fluid communication with the low pressure actuation fluid reservoir 13 via the drain lines 14, 15. The spool valve member 27 is operably coupled to move in a corresponding manner with a moveable portion of the solenoid actuator 30, preferably the push pin 35 attached to the armature 34. The spool valve member 27 preferably moves with the push pin 35 along the centerline 48 of the valve assembly 20, 120 between the first position and the second position. The valve body 39 defines an annular groove that receives an o-ring that aids in sealing when valve 38 is installed in a fuel injector or other device.

As illustrated, when the push pin 35 and the spool valve member 27 are in the first position, a first stop surface 45*a* of the push pin 35 is resting against a plate 44 positioned between the push pin 35 and the stator 32. The actuation passage 41 is in fluid communication with the low pressure actuation fluid reservoir 13 via the first annulus 49*a*, the drain passage 42 and the drain line 14, 15. When the push pin 35 and spool valve member 27 are in the second position, the first stop surface 45*a* of the push pin 35 is not in contact with the plate 44, and spool valve member 27 establishes fluid communication between the actuation passage 41 and the common rail 12 via the second annulus 49*b*, the supply passage 40, and the supply line 18, 19. Further, when the push pin 35 and the spool valve member 27 are in its second position, a second stop surface 45*b* of the spool valve member 27 is in contact with a second stop 46 of the valve body 39. Because the spool valve member 27 is coupled to the push pin 35 rather than attached to the push pin 35, an asymmetrical magnetic force pulling the push pin 35 off the centerline 48 or a mechanical misalignment will not undermine the movement of the spool valve member 27.

Referring to FIG. 3, there is shown a sectioned side diagrammatic view of a fuel injector according to the present invention. A hydraulic device body, which in this instance is the injector body 50, of the fuel injector 16 includes a flow control portion 51, a pressure intensifying portion 52, and a nozzle portion 53. The control portion 51 includes the fluid control valve assembly 20, which is attached to the injector body 50. The actuation passage 41 of the fluid control valve 38 is fluidly connected to a second portion of the fluid passage, which in this instance is the piston bore 54 that is defined by the injector body 50. An intensifier piston 55 is movably positioned within the piston bore 54 and has a stepped top hydraulic surface 56 that is exposed to fluid pressure within the piston bore 54. The intensifier piston 55 is biased toward a retracted, upward position as shown by a biasing spring 57. A plunger 58 is also moveably positioned in the injector body 50 and moves in a corresponding manner with the intensifier piston 55. When the push pin 35 and the spool valve member 27 are in the second position and the actuation passage 41 of the fluid control valve 38 is in fluid communication with the common rail 12, there is pressurized actuation fluid acting on the piston hydraulic surface 56, causing the intensifier piston 55 to move toward its advanced position. The plunger 58 also advances and acts to pressurize fuel within a fuel pressurization chamber 59. As illustrated, when the push pin 35 and the spool valve member 27 are in the first position and the actuation passage 41 of the fluid control valve 38 is in fluid communication with the low pressure reservoir 13, the piston hydraulic surface 56 is exposed to low pressure actuation fluid. Thus, the intensifier piston 55 will remain in, or move toward, its retracted, upward position under the action of the biasing spring 57. When the plunger 58 is returning to the upward position, fuel is drawn into the fuel pressurization chamber 59 in preparation for the next injection event.

The fuel pressurization chamber 59 is fluidly connected to nozzle outlets 60 via a nozzle supply passage 61, of which only a portion is visible in the section view of FIG. 3. A nozzle member 62, which is preferably a direct control member, is positioned within the nozzle portion 53 of the injector body 50, and is moveable between an open position and a closed position. The nozzle member 62 is biased by a spring 68 to a closed position, as shown, in which it closes the nozzle outlets 60. Although the opening and closing of the nozzle outlets 60 could be controlled by varying methods, it is preferably controlled, at least in part, by a needle control valve 63 positioned in the nozzle portion 53 of the injector body 50. The needle control valve 63 includes a control valve member 64 that is moveable between a first position and a second position. The control valve member 64 is biased to the first position in which a closing hydraulic surface 66 of the nozzle member 60 is in fluid communication with the nozzle supply passage 61, via a passage not visible in this section view. When the control valve member 64 is in the second position, the closing hydraulic surface 66 is in fluid communication with a source of low pressure, preferably the low pressure fuel supply, via a passage not visible. The nozzle member 62 can move to its open position when pressure on its opening hydraulic surface 67 is sufficient to overcome the bias of the spring 68 and the hydraulic force on the closing hydraulic surface. When the nozzle member is in the open position, the nozzle outlets 60 are open. The control valve member 64 is preferably coupled to a second solenoid actuator 65. Although the present invention is illustrated with the solenoid actuator 65, those skilled in the art should appreciate that the present invention contemplates the use of any type of electrical actuator 63, such as a piezo actuator. The second solenoid actuator 65 is in communication with the electronic control module 24. It should be appreciated that the second solenoid actuator 63 could be in communication with the electronic control module 24 via the communication line 22, including four wires, one pair for each electrical actuator within the fuel injector 16, or a separate communication line between the second electrical actuator 65 and the electronic control module 24.

Referring to FIG. 4, there is shown a sectioned side diagrammatic representation of the engine brake 17 according to the present invention. The engine brake 17 is preferably any gas exchange valve that is positioned in the engine 10 to vent compressed air within the engine cylinder (not shown) toward the end of a compression stroke for an engine piston. The engine brake 17 has an hydraulic device body, which in this instance is an engine brake body 70, that defines a brake fluid passage 71. The fluid control valve assembly 120 is attached to the engine brake body 70. The second portion of the fluid passageway, in this instance is a brake fluid passage 71, is fluidly connected to the actuation passage 41 of the flow control valve 38 (FIG. 2). A hydraulic actuator, piston 72, is positioned in the engine brake body 70 and is movable between a retracted, upward position and an advanced, downward position as shown. An engine brake valve member 73 moves in a corresponding manner with the piston 72. Piston 72 is biased toward its retracted position by a biasing spring 74. When the push pin 35 and the spool valve member 27 are in the first position causing the first annulus 49*a* of the spool valve member 27 to open fluid communication between the actuation passage 41 and the drain passage 42, the brake fluid passage 71 of the engine brake 17 is fluidly connected to the low pressure actuation fluid reservoir 13. The piston 72 will remain in, or move toward, its retracted position, and the engine brake valve member 73 closes the valve seat 75. When the push pin 35 and the spool valve member 27 are in the second position, the second annulus 49*b* opens fluid communication between the actuation passage 41 and the supply passage 40, and the fluid passage 71 of the engine brake 17 is in fluid communication with the common rail 12. The piston 72 pushes the engine brake valve member 73 downward to open the valve seat 75, allowing the engine compression release brake 17 to open the engine cylinder to an exhaust passage 76.

Figure 5:
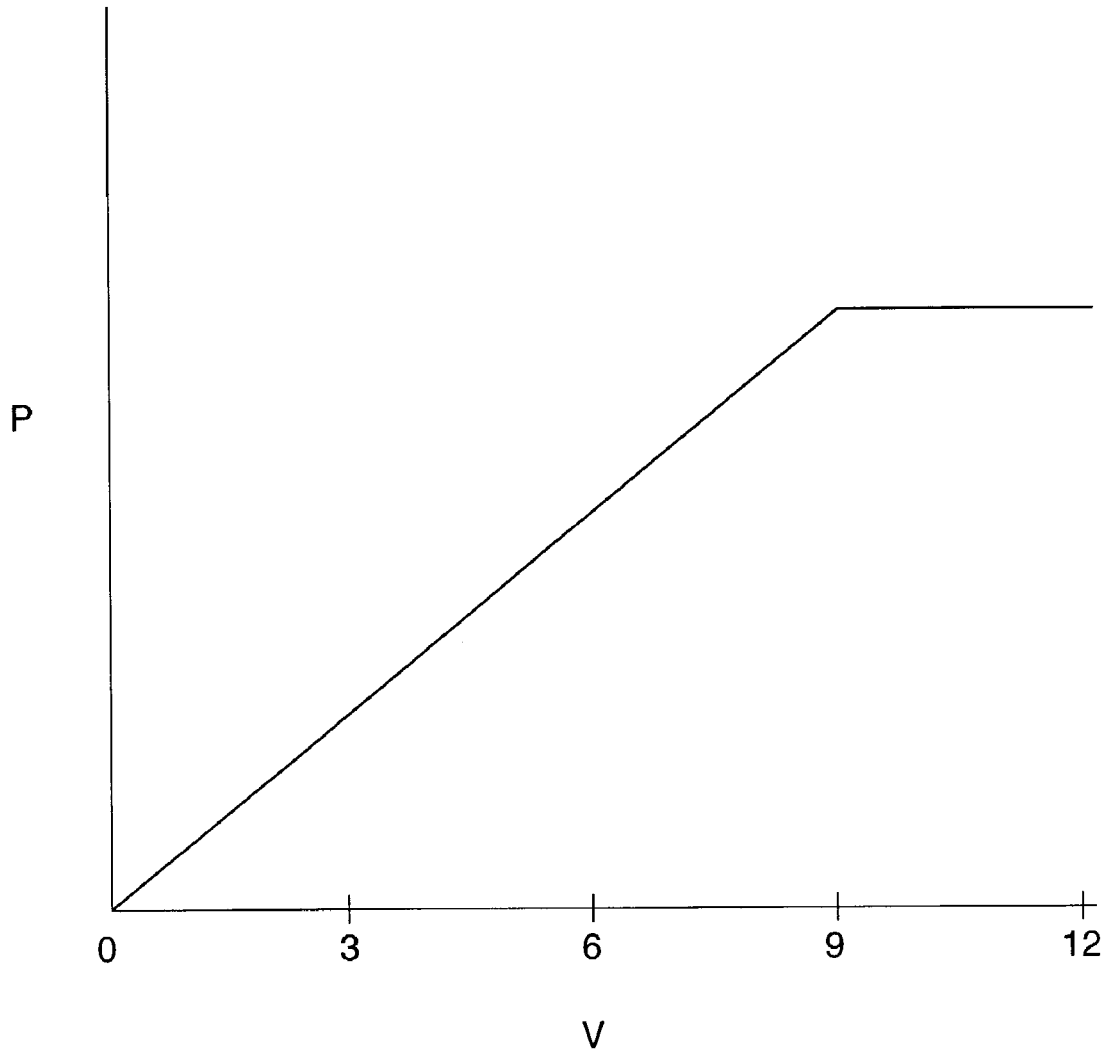
FIG. 5 is a graph illustrating rail pressure versus the voltage available to the fluid control valve assembly of FIG. 2 according to the present invention.

Referring to FIG. 5, there is a graph illustrating maximum rail pressure (P) within the common rail 12 versus the voltage (V) required to operate the fluid control valve assembly 20, 120. In order to maintain operation of the fluid control valve assemblies 20, 120, the electronic control module 24 can compensate for a decrease in the voltage available to the solenoid actuator 30 by limiting the rail pressure (P). In order to move the spool valve member 27, and hold the member 27, in the second position, there must be sufficient voltage available to the solenoid actuator 30 to overcome not only the bias the spring 28, but also fluid forces created by a pressure differential across the fluid control valve 38. As the pressurized fluid flows from the common rail 12 and the supply passages 18 and 19 to the fuel injector 16 and the engine brake 17, respectively, the fluid initially flows from relatively high pressure within the common rail 12 to relatively low pressure within the fuel injector 16 and the engine brake 17. The higher the rail pressure (P), the greater the pressure differential across the fluid control valve 38 and the greater the fluid forces. The greater the fluid forces, the more voltage needed to move the spool valve member 27 to the second position and activate the fuel injector 16 and/or engine brake 17.

Based on the voltage available to the solenoid actuator 30, the electronic control module 24 determines the maximum rail pressure (P) at which the solenoid actuator 30 can operate. Generally, when the engine 10 is properly functioning, 9–12 volts are available to the solenoid actuator 30 and are able to operate the fluid control valve assembly 20, 120 at the highest expected rail pressures (P). The highest rail pressures (P) are expected when the demands on the engine 10 are great, such at high speeds and loads. However, when the available voltage falls below a certain level, the voltage is insufficient to pull in, and hold, the spool valve member 27 in its second position at the highest rail pressures (P). Therefore, if the available voltage (V) decreases, the electronic control module 24 will command the variable delivery pump 21 to limit the output of pressurized fluid to the common rail 12, which results in a decrease in the rail pressure to at or under the limited maximum rail pressure of FIG. 5.

Figure 6A:
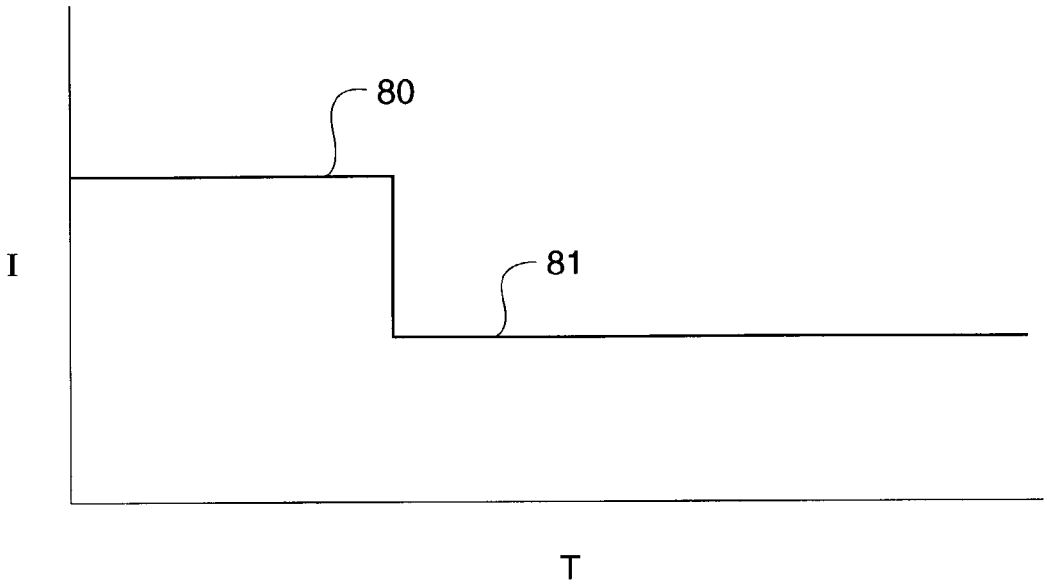
FIG. 6*a* is a graph illustrating electric current supplied to an electrical actuator included in the fluid control valve assembly of FIG. 2 versus time according to the present invention.
Figure 6B:
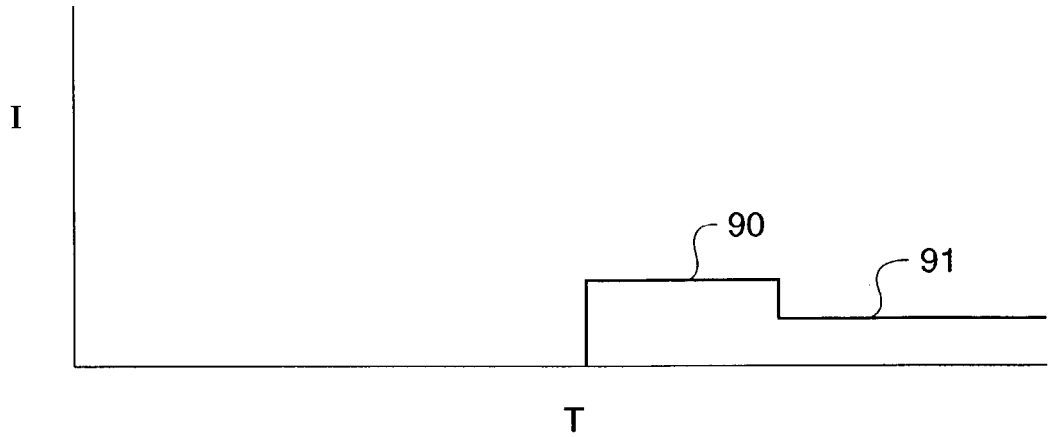
FIG. 6*b* is a graph illustrating electric current supplied to an electrical actuator coupled to a needle control valve versus time according to the present invention.

Referring to FIGS. 6*a* and 6*b*, there are shown two graphs representing the electric current (I) supplied to the first solenoid actuator 30 over time (T), and the electric current (I) supplied to the second solenoid actuator 65 over time (T), respectively. Although it should be appreciated that fuel injectors can include varying numbers of electrical actuators, including but not limited to one electrical actuator, the illustrated fuel injector 16 includes the first solenoid actuator 30 coupled to the fluid control valve 38 and the second solenoid actuator 65 coupled to the direct needle control valve 63. The voltage available to the fuel injector 16 must also be sufficient to energize both solenoid actuators 30, 65 in order to operate both valves 38, 63. The graphs illustrate the amount of electric current (I) supplied to the solenoid actuators 30, 65 during the time (T) in which the fuel injector 16 is preparing for and completing the injection event, preferably a square front-end injection event in which the pressurized fuel is initially injected at a maximum rate. Electric current is preferably supplied to the solenoid actuators 30, 65 in two tiers, a pull-in current 80, 90 and a hold-in current 81, 91. However, it should be appreciated that the two current levels could be separated into additional tiers as the energy required start the valve moving, keep it moving and to hold the valve members 27, 64 in the second position is different. The pull-in current 80, 90 is the electric current required to pull the valve member 27, 64 into its second position. The hold-in current 81, 91 is the electric current required to hold the valve member 27, 64 in the second position. The hold-in current 81, 91 is generally less than the pull-in 80, 90 current. The total amount of time the electric current is supplied to the solenoid actuator 30, 65 is referred to as "on-time." In the illustrated fuel injector, the pull-in current 90 of the second solenoid actuator 65 is less than the hold-in current 81 of the first solenoid actuator 30. It takes less energy to control the needle control valve 64 than the fluid control valve 38 because the needle control valve 63 is smaller than the fluid control valve 38, and the control valve member 64 has less distance to travel than the spool valve member 27. Further, in order to achieve the square injection event, by the point at which the pull-in current 90 is being supplied to move the control valve member 64 to its second position, the hold-in current 81 is being supplied to the first solenoid actuator 30. Thus, because the second solenoid actuator 65 requires less electric current than the first solenoid actuator 30 and because the second solenoid actuator 65 is activated at a different time (T) than the first solenoid actuator 30, the voltage available to the first solenoid actuator 30 should also be sufficient to operate the second solenoid actuator 65.

However, it should be appreciated that there may be an instance in which both the fluid control valve 38 and the needle control valve 63 must be opened close in time in order to achieve the desired fuel injection, such as some rate shaping. For example, in the illustrated fuel injector, in order to achieve a ramp injection, the control valve member 64 must be moved to its second position before or at approximately the same time as spool valve member 27 is moved to its second position. In order to move both valve members 27, 64 to these positions, the voltage available must be sufficient to supply pull-in electric current 80, 90 to the first and second solenoid actuators 30, 65. Even when the hydraulic system 9 is operating on low voltage, there are varying methods for achieving a ramp injection. For instance, the electronic control module 24 could supply pull-in electric current 90 to the second solenoid actuator 65 in order to move the control valve member 64 to its second position prior to sending pull-in current 80 to the first solenoid actuator 30. Thus, both solenoid actuators 30, 65 would not require pull-in current 80, 90 simultaneously and the needle control valve 64 will be in its proper position in order to achieve the ramp injection. It should be appreciated that the need to simultaneously open two electrically controlled valves within a fuel injector varies among the types of fuel injectors.

INDUSTRIAL APPLICABILITY

Referring to FIG. 1, the present invention is illustrated within a hydraulic system 9 supplying oil as the actuation fluid to the fuel injector 16 and the engine brake 17 within the engine 10 that is attached to vehicle 8. However, it should be appreciated that the present invention can be utilized within any electrically controlled fluid system, regardless of whether it is included in an engine. The fluid system must have a valve, and the energy required to operate the valve must be a function of the pressure differential across the valve. For example, the present invention could be used as a backup strategy for any fluid control process, such as an electrically controlled medicine dispenser or possibly some fluid related manufacturing process, during a power shortage. The invention could also find application to wheeled vehicles, such as trucks and work machines, and non-wheeled vehicles such as boats or planes, or even spacecraft. Further, the valve assembly 20, 120 controls the flow of actuation fluid to and from the fuel injector 16 and the engine brake 17. Although the operation of the present invention will be discussed for one fuel injector 16 and one engine brake 17, it should be appreciated that the present invention can be utilized in an engine having any number of fuel injectors 16 or engine brakes 17 and could be utilized with other hydraulic devices, including others within the engine 10. Although the fuel injector valve assembly 20 and the engine brake valve assembly 120 operate in a similar manner, it should be appreciated that the solenoid actuator 30 of the fuel injector valve assembly 20 and the engine brake valve assembly 120 will not be activated simultaneously.

Referring to FIGS. 1–3 and 5–6, a variety of sensors are sensing the demands being placed on the engine 10 and the conditions under which the hydraulic system 9 is operating. The sensors communicate these demands and conditions to the electronic control module 24 via communication lines. These sensors could include but are not limited to, an oil temperature sensor, a throttle sensor, a timing sensor, a boost pressure sensor, a speed sensor, the pressure sensor 68, and the voltage sensor 66. The electronic control module 24 determines the timing and quantity of the fuel injection required to meet the demands and conditions being placed on the engine 9. The electronic control module 24 then calculates the parameters required to achieve the desired fuel injection, such as the desired rail pressure, the desired start of a control signal to the needle control valve 63, and the desired on-time of the needle control valve 63.

The pressure sensor 68, preferably positioned within the common rail 12 is periodically sensing the pressure within the common rail 12. The actual pressure is communicated to the electronic control module 24 via the pump communication line 69. The voltage sensor 66 positioned within the electrical circuitry in communication with the solenoid actuator 30 is periodically sensing the voltage available to the solenoid actuator 30. Preferably, the frequency of sampling of the pressure and voltage is selected in order to detect a mean or average pressure and voltage that is not too sensitive to transient effects. The voltage sensor 66 communicates the voltage to the engine hydraulic system voltage availability monitoring algorithm that determines the available voltage to solenoid actuator 30 coupled to the fluid control valve 38. The voltage comparison algorithm recorded in the memory of the electronic control module 24 will compare the actual voltage available to the solenoid actuator 30 with a predetermined voltage. The predetermined voltage can be the voltage required to operate the fluid control valve assembly 20 included in the fuel injector 16 at the highest rail pressures. In other words, when the predetermined voltage is available, sufficient electric current can be supplied to the solenoid actuator 30 in order to pull in and hold the spool valve member 27 in the second position at all rail pressures, including the highest expected rail pressures.

If the voltage comparison algorithm determines that the available voltage is greater than the predetermined voltage, the low electrical energy-pressure limiting algorithm will cease its process and the hydraulic system 9 will operate in a conventional mode. If the voltage comparison algorithm determines that the available voltage is less than the predetermined voltage, the common rail pressure determining algorithm included within the pressure limiting algorithm will calculate a maximum rail pressure (FIG. 5). The maximum rail pressure is a function of the actual voltage available, and thus, changes as the voltage available changes. The maximum rail pressure is the pressure at which the fluid control valve assembly 20 can operate with the voltage available to the solenoid actuator 30. As illustrated in FIG. 5, the less voltage (V) available to the solenoid actuator 30, the lower the rail pressure (P) at which the fluid control valve assembly 20 can operate. The electronic control module 24 will then compare the maximum rail pressure to the desired rail pressure. If the desired rail pressure is less than the maximum rail pressure, such as when the engine is idling or operating at low speeds and loads, the engine hydraulic system rail pressure controlling algorithm will command the variable delivery pump 21 via the pump communication line 25 to control pump output in order to achieve the desired rail pressure. If the desired rail pressure is greater than the maximum rail pressure, such as when the hydraulic system 9 is operating at low voltage and the vehicle is operating at high speeds and loads, the engine hydraulic system rail pressure controlling algorithm commands the pump 21 to limit the rail pressure to the limited maximum rail pressure.

Shortly before the injection event, the pressure sensor 68 will again sense the rail pressure and communicate it to the electronic control module 21 via the communication line 69. The electronic control module 24 will compare the actual rail pressure to the desired rail pressure, which was used to calculate the start of the control signal to, and the on-time of, the second solenoid actuator 65. If in the low voltage mode and the desired rail pressure is greater than the actual pressure, the electronic control module 24 will adjust the on-time and the start of the control signal in order to inject the desired amount of fuel into the engine cylinder at the desired time. The greater the difference between the desired rail pressure and the actual rail pressure, the greater the increase in the on-time of the second solenoid actuator 65 and the earlier the electronic control module 24 will likely start the control signal to the direct needle control valve 64. It should be appreciated that even when the hydraulic system 9 is operating within a normal range of voltage, the electronic control module 24 adjusts the fuel injector 16 control signals in order to compensate for small changes within the common rail between the desired rail pressure and the actual rail pressure due to the dynamics of the hydraulic system 9.

After adjusting the control signals to take account of the difference between the actual and desired rail pressures, the electronic control module 24 may truncate the on-time of the second solenoid actuator 65 coupled to the direct needle valve 63 depending on a smoke limiting map and/or a torque limiting map. The smoke limiting map within the electronic control module 24 determines the maximum amount of fuel that can be injected at that operating condition without the engine 10 producing excess smoke, such as when the vehicle is accelerating from a stop. If the electronic control module 24 determines that it is asking for more fuel to be injected into the engine cylinder than the smoke limiting map permits, it will truncate the on-time of the needle control valve 63 in order to reduce the amount of fuel being injected. The smoke limiting map preferably reduces undesirable emissions that occur from unburned fuel. Further, the torque limiting map within the electronic control module 24 will reduce the on-time of the needle control valve 63 if the electronic control module 24 is asking the fuel injector 16 to inject an amount of fuel that may produce a torque on the engine 9 that is too large. The torque limiting map preferably avoids engine breakage from being over-torqued.

After the electronic control module 24 adjusts the on-time and start of the control signal in order to achieve the desired fuel injection at the actual rail pressure as adjusted by the limiting maps, the electronic control module 24 communicates to the fluid control valve assembly 20 via the fuel injector communication line 22 the adjusted control signals. The electronic control module 24 will energize the solenoid actuator 30 by sending electric current through solenoid coil 31. The energized solenoid coil 31 creates an electromagnetic flux that attracts the magnetic armature 34. Because the armature 34 is attached to the push pin 35, the push pin 35 moves correspondingly with the armature 34. The spool valve member 27 which is operably coupled to move with the push pin 35, moves against the bias of the spring 28. As the spool valve member 27 moves against the bias of the spring 28, the spool valve member 27 begins to block fluid communication between the drain passage 42 and the first annulus 49*a*, and begins to open fluidly communication between the supply passage 40 and the second annulus 49*b*. As the spool valve member 27 moves to its second position, changes in pressure within the annulus 49*a* and 49*b* cause fluid forces that act against the movement of the spool valve member 27 to the second position. The pressure differential created between the relatively high pressure in the supply line 18 and the relatively low pressure in the piston bore 54 causes the fluid to increase in velocity as it flows from the supply passage 18 to the piston bore 54, especially in the area around the valve seat. The greater the pressure within the supply line 18, the faster the fluid flows through the supply passage 40, second annulus 49*b*, and actuation passage 41. According to Bernoulli's principle, the increase in the velocity of the fluid results in a pressure decrease in the second annulus 49*b*. The unequal pressure within the first annulus 49*a* and the second annulus 49*b* can result in undesirable flow forces.

Regardless of how the flow forces are created, the solenoid actuator 30 must have enough energy to move and hold the spool valve member 27 against the bias of the spring 28 and the flow forces. Because the variable delivery pump 21 limited the rail pressure to a limited maximum pressure, the pressure within the supply line 18 is less than it would be if the hydraulic system 9 was operating at a rated voltage level. Reducing the pressure within the supply line 18 results in a decrease in the pressure differential, and thus, a reduction in the velocity of the fluid flowing across the second annulus 49*b*. The pressure imbalance between the annulus 49*a* and 49*b* is lessened, thereby reducing the flow forces acting against the movement of the spool valve member 27. The electric current supplied to the solenoid actuator 30 will be sufficient to pull the spool valve member 27 into its second position against the action of the spring 28 and the lessened flow forces. When in the second position, the fluid at the limited maximum rail pressure will flow from the common rail 12 through the supply line 18, the supply passage 40 of the valve body 39, the second annulus 49*b* of the spool valve member 27, and the actuation passage 41 of the valve body 39. The fluid then flows to the piston bore 54, in which it acts on the hydraulic surface 56 of the piston 55. Those skilled in the art will appreciate that as the spool valve member 27 remains in its second, or open position, the electronic control module 24 will reduce the amount of electric current it sends through the solenoid coil 31 because less energy is required to hold the spool valve member 27 in the second position than is required to move the spool valve member 27 to its second position. As illustrated in FIG. 6, the pull-in current 80 is preferably higher than the hold-in current 81.

Referring now to FIGS. 3, 5, and 6, the pressurized actuation fluid acting upon the piston hydraulic surface 56 advances the intensifier piston 55 and the plunger 58 to their downward position against the bias of the spring 57. The advancing plunger 58 pressurizes the fuel within the fuel pressurization chamber 59. Just prior to the desired start of the injection event, the electronic control module 24 energizes the second solenoid actuator 65. The energized solenoid actuator 65 pulls the control valve member 64 to its second position in which the closing hydraulic surface 66 of the nozzle member 62 is exposed to low pressure. Thus, the pressurized fuel flowing into the nozzle supply passage 61 from the fuel pressurization chamber 59 acting on the opening hydraulic surface 67 is sufficient to lift the nozzle member 62 against the bias of the spring 68. The fuel is then injected via the nozzle outlets 60 into the engine cylinder. The timing and duration of the injection is controlled, at least in part, by the activation of the second solenoid actuator 65. The lower the maximum rail pressure, the longer the fuel will take to flow from the fuel pressurization chamber 59 to the nozzle supply passage 61 and out the nozzle outlets 60. Because the electronic control module 24 previously determined that the actual pressure of actuation fluid within the common rail 12 was lessened, the electronic control module 24 will likely start the control signal to the second solenoid actuator 65 at an earlier point within the engine cycle in order to compensate for the slower flowing pressurized fuel and to achieve the desired timing of the injection. Further, when the maximum rail pressure is lowered, the duration of the injection must be increased in order to achieve the desired injection amount. Therefore, the second solenoid actuator 65 coupled to the needle control valve 63 has an increased on-time, meaning the electronic control module 24 will energize the second solenoid actuator 65 for a longer duration. During the on-time, the electronic control module 24 will preferably reduce the electric current delivered through the second solenoid actuator 65 from the pull-in current 90 to the hold-in current 91. After the desired injection is completed, the electronic control module 24 will cease sending electric current to the second solenoid actuator 65 and the control valve member 64 will move to its first position in which the closing hydraulic surface 66 is in fluid communication with the nozzle supply passage 61. Further, the opening hydraulic surface 67 will be exposed to low pressure within the supply passage 61, and the nozzle member 62 will return to its first, or closed, position blocking the nozzle outlets 60. In addition, once the injection is completed, the electronic control module 24 will cease sending electric current to the first solenoid actuator 30, and thus, allowing the spool valve member 27 to return to its first position in which the fuel injector 16 is exposed to the fuel injector drain line 14.

Referring to FIGS. 1, 2, 4, and 5, it should be appreciated that whereas the desired timing and duration of the fuel injection changes with the demands being placed on the engine 10, the desired timing and duration of the engine brake release is constant. The engine brake release preferably occurs as the engine piston approaches top dead center position during its compression stroke to achieve maximum braking horsepower. Thus, the desired rail pressure to activate the engine brake 17 should be constant. The desired rail pressure to activate the engine brake 17 when the hydraulic system 9 is operating within the normal voltage range may be predetermined and programmed into the electronic control module 24. When the electronic control module 24 senses that the engine brake 17 is needed to slow the vehicle or machinery, the pressure sensor 68 will sense the actual rail pressure and communicate it to the electronic control module 24 via the pressure sensor communication line 69.

The voltage sensor 66 will sense the actual voltage available to the engine brake control valve assembly 120. The voltage sensor 66 communicates the available voltage to the engine hydraulic system voltage availability monitoring algorithm that determines the available voltage to solenoid actuator 30 coupled to the fluid control valve 38. The voltage comparison algorithm recorded on the memory of the electronic control module 24 will compare the actual voltage available to the solenoid actuator 30 with the predetermined voltage. The predetermined voltage can be the voltage required to operate the fluid control valve assembly 120 included in the engine brake 17 at the highest expected rail pressures. In other words, when the predetermined voltage is available, sufficient electric current can be supplied to the solenoid actuator 30 in order to pull and hold the spool valve member 27 in its second position in order to activate the engine brake 16 at the highest expected rail pressures.

If the voltage comparison algorithm determines that the available voltage is greater than the predetermined voltage, the low electrical energy-pressure limiting algorithm will cease its process and the hydraulic system 9 will operate in the normal voltage mode. If the voltage comparison algorithm determines that the available voltage is less than the predetermined voltage, the rail pressure determining algorithm included within the pressure limiting algorithm will calculate a limited or lowered maximum rail pressure. The maximum rail pressure is a function of the actual voltage available, and thus, changes as the voltage available changes. It is the maximum rail pressure at which the fluid control valve assembly 120 can operate with the voltage available to solenoid actuator 30. As illustrated in FIG. 5, the less voltage (V) available to the solenoid actuator 30, the lower the maximum rail pressure (P) at which the fluid control valve assembly 120 can operate. The electronic control module 24 will then compare the maximum rail pressure to the desired rail pressure. If the desired rail pressure is less than the maximum rail pressure, the electronic control module 24 will command the variable delivery pump 21 via the pump communication line 25 to control pump output in order to achieve the desired rail pressure. If the desired rail pressure is greater than the maximum rail pressure, the engine hydraulic system rail pressure controlling algorithm commands the pump 21 to limit the rail pressure to the maximum rail pressure.

After commanding the variable delivery pump 21 to limit to the common rail 12 at the maximum rail pressure, the pressure sensor 68 will again sense the rail pressure and communicate it to the electronic control module 24 via the communication line 69. The electronic control module 24 will compare the actual rail pressure to the desired rail pressure to activate the engine brake 17. Because the engine brake member 73 is, at least in part, exposed to pressure within the engine cylinder, engineers have calculated the desired rail pressure to be sufficient to move, and hold, the piston 72 and the engine brake valve member 73 off the valve seat 75 against the engine cylinder pressure at top dead center. If the electronic control module 24 determines that the actual rail pressure is insufficient to move, and hold, the engine brake valve member 73 off its seat against the engine cylinder pressure at top dead center, it will adjust the timing of the start of the control signal to the fluid control valve assembly 120 to advance the timing of the blow down event. The electronic control module 24 will send the start of the control signal earlier to the solenoid actuator 30. Thus, the energized solenoid actuator 30 will fluidly connect the supply passage 19 to the moveable piston 72 within the engine brake fluid passage 71 at an earlier point within the engine cycle, causing the engine brake 17 to release the cylinder contents earlier in the compression stroke. Because there is less pressure within the cylinder earlier in the compression stroke, the actual limited rail pressure can advance the piston 72 and engine brake valve member 73 against the lower cylinder pressure. Although advancing the timing of the brake release results in less braking horsepower, it will allow the operation of the engine brake 17 at lower rail pressures. If the actual rail pressure is greater than the rail pressure required to move the engine brake member 75 against the engine cylinder pressure at top dead center, the electronic control module 24 will not adjust the start of the control signal. Rather, the electronic control module 24 will energize the solenoid actuator 30 at the timing which results in the brake release occurring at top dead center for maximum braking horse power.

After the electronic control module 24 adjusts the start of the control signal to the solenoid actuator 30 coupled to the fluid control valve 38, the electronic control module 24 communicates to the fluid control valve assembly 120 via the engine brake communication line 23 the adjusted control signal. The electronic control module 24 will energize the solenoid actuator 30 by sending electric current through the solenoid coil 31. The energized solenoid coil 31 creates an electromagnetic flux that attracts the magnetic armature 34. Because the armature 34 is attached to the push pin 35, the push pin 35 moves correspondingly with the armature 34. The spool valve member 27 which is operably coupled to move with the push pin 35, moves against the bias of the spring 28. As the spool valve member 27 moves against the bias of the spring 28, the spool valve member 27 begins to block fluid communication between the drain passage 42 and the first annulus 49*a*, and begins to open fluidly communication between the supply passage 40 and the second annulus 49*b*. As the spool valve member 27 moves to its second position, changes in pressure within the annulus 49*a* and 49*b* cause fluid forces that act against the movement of the spool valve member 27 to the second position.

Regardless of how the flow forces are created, the solenoid actuator 30 must have enough energy to move and hold the spool valve member 27 against the bias of the spring 28 and the flow forces. Because the variable delivery pump 21 limited the output of pressurized actuation fluid to the common rail 12 to a lowered maximum pressure, the pressure within the supply line 19 is less than it would be if the hydraulic system 9 was not operating in a low voltage mode. Reducing the pressure within the supply line 19 results in a decrease in the pressure differential, and thus, a reduction the velocity of the fluid flowing across the second annulus 49*b*. The pressure imbalance between the annulus 49*a* and 49*b* is lessened, thereby reducing the flow forces acting against the spool valve member 27. The electric current supplied to the solenoid actuator 30 will be sufficient to pull the spool valve member 27 into its second position against the action of the spring 28 and the lessened flow forces. When in the second position, the fluid at the maximum rail pressure will flow from the common rail 12 through the supply line 19, the supply passage 40 of the valve body 39, the second annulus 49*b* of the spool valve member 27, and the actuation passage 41 of the valve body 39. The fluid then flows to the brake fluid passage 71 and advances the piston 72 against the biasing spring 74, moving the engine brake valve member 73 off of the valve seat 75. The engine brake 17 can vent the contents of the engine cylinder via the exhaust passage 76. This preferably occurs as the engine piston approached its to dead center position during its compression stroke to achieve maximum braking horsepower, but can be advanced if the rail pressure is too low to move the engine brake member 73 at top dead center. Because the flow of the actuation fluid from the supply line 19 to the brake fluid passage 71 has slowed with the decrease in pressure, the electronic control module 24 might start the control signal to the solenoid actuator 30 earlier in order to achieve the desired timing of the blow down event.

Those skilled in the art will appreciate that the electronic control module 24 will reduce the amount of electric current it sends through the solenoid coil 31 as the spool valve member 27 remains in the second position. The pull-in current should be higher than the hold-in current. Once the compressed air has been vented from the engine cylinder, the electronic control module 24 will de-energize the solenoid actuator 30 and the spool valve member 27 will move to its first position in which the engine brake 17 is fluidly connected to the engine brake drain line 15.

Overall, the present invention is advantageous because it can find application in any fluid system including an electrically-actuated valve. The present invention can serve as a back-up strategy in a power shortage situation. Any valve controlling the flow of fluid across a pressure differential is subjected to fluid forces. The valve member, regardless of shape and type, must move not only against its bias, but also against these fluid forces. By decreasing the pressure differential, by either decreasing the pressure on the high pressure side of the valve or increasing the pressure on the low pressure side of the valve, these flow forces are reduced. Thus, the valve can still control the flow of fluid even in the low voltage situation, such as in a power shortage.

In addition to the widespread application of the present invention, the present invention is advantageous because of its application within the engine hydraulic system 9. Federal regulations require most vehicles and machinery to be able to operate within a range of 9–12 volts. The present invention could be used as a strategy to operate the vehicle or machinery at the lower end of the required voltage range, such as at 9–10 volts, or even below the required range. Further, the present invention is advantageous because it maintains sufficient operation of the vehicle or machinery in order to drive the vehicle or machinery to a service location to fix the problem which is causing the low voltage situation. This can reduce towing expenses, inconveniences, and expensive down time.

It should be appreciated that although the present invention described the electrical energy available to the fuel injection system in terms of voltage, the electrical energy in other electrically-controlled fluid systems could be described in other terms, such as electric current. Because the resistance within the illustrated fuel injection system is constant, any change in the electric current supplied to the solenoid actuator 30 will be a function of a change in the available voltage. However, this may not hold true for other systems.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A method of operating an electrically controlled fluid system, comprising the steps of:

positioning a valve within a fluid passageway;

coupling the valve to an electrical actuator;

monitoring electrical energy available to the electrical actuator; and limiting a pressure differential across the valve when the electrical energy available to the electrical actuator is less than a predetermined electrical energy.

2. The method of claim 1 wherein the step of positioning includes the steps of:

separating the fluid passageway into a first portion above the valve and a second portion below the valve; and fluidly connecting the first portion of the fluid passageway to a common rail and the second portion of the fluid passageway to at least one hydraulically actuated device.

3. The method of claim 2 including the step of exposing a hydraulic surface of a piston included in a fuel injector to pressure within the second portion of the fluid passageway.

4. The method of claim 1 wherein the step of coupling includes the steps of:

operably coupling a valve member of the valve to move with a moveable portion of the electrical actuator; and fluidly connecting the fluid passageway to a passage of at least one of a fuel injector and an engine brake.

5. The method of claim 1 wherein the step of monitoring includes a step of establishing communication between an electronic control module and a voltage sensor.

6. The method of claim 1 wherein the step of limiting includes a step of limiting pressure in the first portion of the fluid passageway.

7. The method of claim 6 wherein the step of limiting includes the steps of establishing communication between an electronic control module and a pressure controlling device; and programming the electronic control module to command the pressure controlling device to limit fluid pressure when voltage available to the electrical actuator is less than a predetermined voltage.

8. The method of claim 7 wherein the step of limiting includes a step of including the pressure controlling device as a portion of a variable delivery pump.

9. The method of claim 8 including the steps of:

separating the fluid passageway into a first portion above the valve and a second portion below the valve;

fluidly connecting the first portion of the fluid passageway to a common rail and the second portion of the fluid passageway to a fluid passageway included in at least one of a fuel injector and an engine brake;

operably coupling a valve member of the valve to move with a moveable portion of the electrical actuator; and establishing communication between the electronic control module and a voltage sensor.

10. An electrically controlled fluid system, comprising:

a fluid passage including a first portion and a second portion separated by a valve, and the first portion being fluidly connected to a source of pressurized fluid; the valve being coupled to an electrical actuator;

a pressure controlling device operably coupled to the source of pressurized fluid;

an electronic control module including a low electrical energy-pressure limiting algorithm and being in control communication with the electrical actuator and the pressure controlling device, and including means for monitoring electrical energy available to the electrical actuator, and the algorithm being operable to limit a pressure differential across the valve when the electrical energy available to the electrical actuator is less than a predetermined electrical energy.

11. The system of claim 10 wherein the fluid system is a hydraulic system; and a movable piston of at least one hydraulic device is exposed to pressure within the second portion of the fluid passage.

12. The system of claim 11 wherein the hydraulic device is one of a fuel injector and an engine brake.

13. The system of claim 12 wherein the source of fluid is a common rail containing actuation fluid different than fuel.

14. The system of claim 10 wherein the pressure controlling device is included as a portion of a variable delivery pump.

15. The system of claim 10 wherein the electrical actuator includes a solenoid; and the valve is a three-way flow control valve including a spool valve member moveable between a first position and a second position;

the fluid passageway including a third portion being fluidly connected to a source of low pressure; and when the spool valve member is in the first position, the second portion of the fluid passageway is fluidly connected to the source of low pressure via the third portion of the passageway; and when the spool valve member is in the second position, the second portion of the passageway is fluidly connected to the source of high pressure via the first portion of the passageway.

16. The system of claim 15 wherein the fluid system is a hydraulic system;

a moveable piston of at least one of a fuel injector and an engine brake is expose to pressure within a second portion of the fluid passageway;

the source of pressurized fluid is a common rail containing actuation fluid different than fuel; and the pressure controlling device is included as a portion of a variable delivery pump.

17. An article comprising:

a computer readable data storage medium;

an electrical energy availability monitoring algorithm recorded on the medium, and being operable to monitor electrical energy available to an electrical actuator coupled to a valve that is positioned in a fluid passageway downstream from a source of pressurized fluid;

a low energy determining algorithm recorded on the medium; and a pressure limiting algorithm recorded on the medium and operable when the low energy determining algorithm determines available electrical energy is less than a predetermined electrical energy.

18. The article of claim 17 wherein the electrical energy availability monitoring algorithm includes a engine hydraulic system voltage monitoring algorithm.

19. The article of claim 17 wherein the low energy determining algorithm includes a voltage comparison algorithm.

20. The article of claim 17 wherein the pressure limiting algorithm includes a common rail pressure determining algorithm and an engine hydraulic system rail pressure controlling algorithm.

* * * * *